US005159806A

United States Patent [19]

Mori et al.

[11] Patent Number: 5,159,806

[45] Date of Patent: * Nov. 3, 1992

[54] APPARATUS FOR PRODUCING SPUN YARNS

[75] Inventors: Shigeki Mori, Ohtsu; Kazuhiko Mikami, Kyoto, both of Japan

[73] Assignee: Murata Kikai Kabushiki Kaisha, Kyoto, Japan

[ * ] Notice: The portion of the term of this patent subsequent to Sep. 15, 2009 has been disclaimed.

[21] Appl. No.: 612,410

[22] Filed: Nov. 13, 1990

[30] Foreign Application Priority Data

| | | | |
|---|---|---|---|
| Nov. 14, 1989 | [JP] | Japan | 1-295594 |
| Feb. 5, 1990 | [JP] | Japan | 2-10342[U] |
| Feb. 5, 1990 | [JP] | Japan | 2-10343[U] |
| Feb. 5, 1990 | [JP] | Japan | 2-10344[U] |
| Feb. 5, 1990 | [JP] | Japan | 2-10346[U] |

[51] Int. Cl.[5] ..... D01H 5/28; D01H 1/115

[52] U.S. Cl. ..... 57/328; 57/5; 57/333; 57/344; 57/350

[58] Field of Search ..... 57/5, 332-333, 57/328, 341-344, 350

[56] References Cited

U.S. PATENT DOCUMENTS

| | | | |
|---|---|---|---|
| 983,641 | 2/1911 | Pease | 57/344 |
| 2,430,944 | 11/1947 | Noguera | 57/344 |
| 3,217,482 | 11/1965 | Baer | 57/350 X |
| 3,702,055 | 11/1972 | Kosaka et al. | 57/333 X |
| 4,112,658 | 9/1978 | Morihashi | 57/328 |
| 4,457,130 | 7/1984 | Sakai et al. | 57/328 |
| 4,827,710 | 5/1989 | Nishimura | 57/5 |
| 4,845,932 | 7/1989 | Sakai et al. | 57/5 |
| 4,958,487 | 9/1990 | Suganuma et al. | 57/328 |

*Primary Examiner*—Daniel P. Stodola
*Assistant Examiner*—William Stryjewski
*Attorney, Agent, or Firm*—Spensley Horn Jubas & Lubitz

[57] ABSTRACT

An apparatus for producing of real twist-like yarns wherein a guide member is provided within a nozzle block for exerting a turning stream on a fiber bundle moved out of a drafting device and an extreme end of the guide member is directed at an inlet of a rotary or stationary spindle.

22 Claims, 6 Drawing Sheets

APPARATUS FOR PRODUCING SPUN YARNS

FIELD OF THE INVENTION

The present invention relates to an apparatus for producing spun yarns, and more specifically to an apparatus for producing spun yarns by twisting an untwisted bundle of short fibers drafted by a drafting apparatus.

RELATED ART STATEMENT

Conventional spinning machineries are roughly classified into three types, a ring type, an open end type and a pneumatic type. Among these types, the pneumatic type spinning machine has been recently developed, which is capable of achieving spinning at high speeds several times that of the ring type, one example of which is disclosed in Japanese Patent Publication No. 53(1978)-45422 (U.S. Pat. No. 4,112,658). In the apparatus shown in said patent, two air jet nozzles are disposed adjacent to a drafting device, each nozzle exerting a flow of compression air which turns in a direction opposite to each other on a fiber bundle moved out of the drafting device. The fiber bundle is twisted by the second nozzle, and the twisted fiber bundle is ballooned by the first nozzle. A part of the fibers is wound on the other fibers by said ballooning, and the fiber bundle passes through the second nozzle to become untwisted whereby they are powerfully wound. In this manner, a spun yarn is produced.

The yarns obtained by the aforementioned conventional pneumatic type spinning machine will be studied in detail. It has been found that the yarns are bundled spun yarns wherein untwisted or soft core fibers have spirally wound thereabout other fibers. A ratio of core fibers to wound fibers, a winding mode of fibers and the like can be somewhat changed by variously changing the spinning conditions. Properties of yarns such as strength can be also changed accordingly. However, since the fibers are wound by unstable ballooning, when the length of fibers increases, it is difficult for the pneumatic type spinning machine to stabilize the behavior of the wound fibers. Moreover, this spinning machine has a problem in that since two nozzles are used, the consumption of compressed air is large, cost of energy is high, and the spinning ability for long fibers such as wool involves considerable difficulty. The present invention has been achieved in view of such circumstances as noted above.

OBJECT AND SUMMARY OF THE INVENTION

An object of the invention is to provide a new spinning apparatus in place of the aforementioned conventional pneumatic type spinning machine to thereby overcome the aforesaid problems.

According to the present invention, a fiber bundle guide member is provided inside or outside a flow of a fiber bundle supplied from a drafting part to a twisting portion.

The present invention provides an apparatus for producing real twist-like yarns wherein a guide member is provided within a nozzle block for exerting a turning stream on a fiber bundle moved out of a drafting device, with an extreme end thereof directed at an inlet of a rotating or stationary spindle.

In the apparatus for producing real twist-like yarns constructed as described above, the fiber bundle moved out of the drafting device is attracted into the nozzle block and exposed to a turning stream in the vicinity of the inlet of the spindle and slightly twisted. At this time, all the fibers of the fiber bundle are positioned in the periphery of the guide member and directly exposed to an air flow to receive a force separating from the fiber bundle. However, since the extreme end of the fiber positioned at the inlet of the spindle is subjected to twisting, it is not easily separated. The separated rear end of the fiber is wound about the outer periphery of the spindle and extends outwardly. The fiber is gradually drawn while turning about the fiber bundle as the fiber bundle runs, and most fibers are spirally wound to form a real twist-like spun yarn.

BRIEF DESCRIPTION OF THE DRAWINGS

FIGS. 4, 6 and 8 show the external appearance of the spun yarns; FIGS. 5, 7 and 9 are views showing the positional relationship between the guide member and the spindle when the spun yarns are produced;

DETAILED DESCRIPTION OF PREFERRED EMBODIMENTS

Embodiments of the present invention will be described hereinafter with reference to the drawings.

Figure 1:
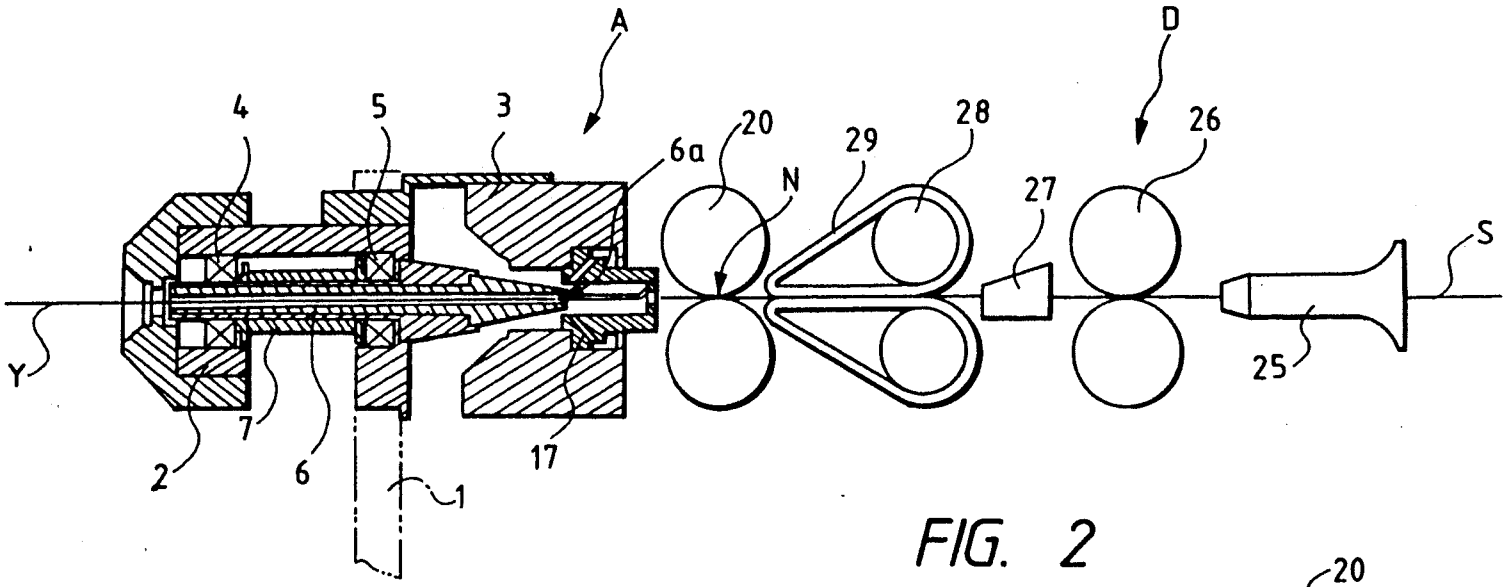
FIG. 1 is a schematic structural view showing an embodiment of a spinning apparatus to which is applied the present invention.

The detailed construction of the spinning apparatus A is shown in FIG. 1. In FIG. 1, a laterally extending line indicates a running path for a fiber bundle S or a spun yarn Y.

Reference numeral 1 designates a support plate secured to a frame. The plate 1 has a hollow cylindrical bearing 2 secured thereto by means of screws or the like, and further has a spindle described later and a casing 3 in the form of a rotary disk secured by means of screws or the like. The casing 3 is composed of a pair of split dies before and behind which are fixed by screws.

A spindle 6 is rotatably supported within the bearing 2 through bearings 4 and 5. A hollow pulley 7 is mounted in the outer periphery of the spindle 6.

Reference numeral 8 designates an endless drive belt stretched along a unit so as to come into contact with the outer peripheral portion of the pulley 7 and driven by means of a motor not shown. The spindle 6 together with the pulley 7 is rotated at a high speed when the belt 8 runs. A rotary body 9 is integrally formed at a position frontwardly of the bearing 5 of the spindle 6.

A fiber bundle passage 10 extends through a center of the spindle 6. The spinning apparatus A is positioned on the same straight line in which both the center of the passage 10 and the center of each hollow portion of the casing 3 are registered with the running path of the fiber bundle S, and the distance between a spindle inlet 6*a* and a front roller nip point N is designed to be shorter than an average length of fibers constituting the fiber bundle S. An outer diameter of the inlet 6*a* of the spindle 6 is sufficiently small, and a portion adjacent to the inlet 6*a* has an outer diameter which increases toward the rotary body 9 to form a conical body 6*b*. A portion to cover the spindle 6 of the casing and the rotary body 9 forms a small diameter cylindrical hollow chamber 11 in the vicinity of the inlet 6*a* of the spindle 6, and a portion adjacent to the hollow chamber 11 forms a conical hollow chamber 12 opened at a large angle.

A portion forwardly of the small diameter hollow chamber 11 forms a large diameter cylindrical configuration which is slightly larger than the diameter of the fore end of the spindle 6, said cylindrical portion serving as a guide passage 13 for the fiber bundle S. The conical hollow chamber 12 is formed in its outer periphery with an annular hollow chamber 14 and a tangential air escape hole 15 continuous to the hollow chamber 14.

An air suction pipe is connected to the air escape hole 15.

Figure 3:
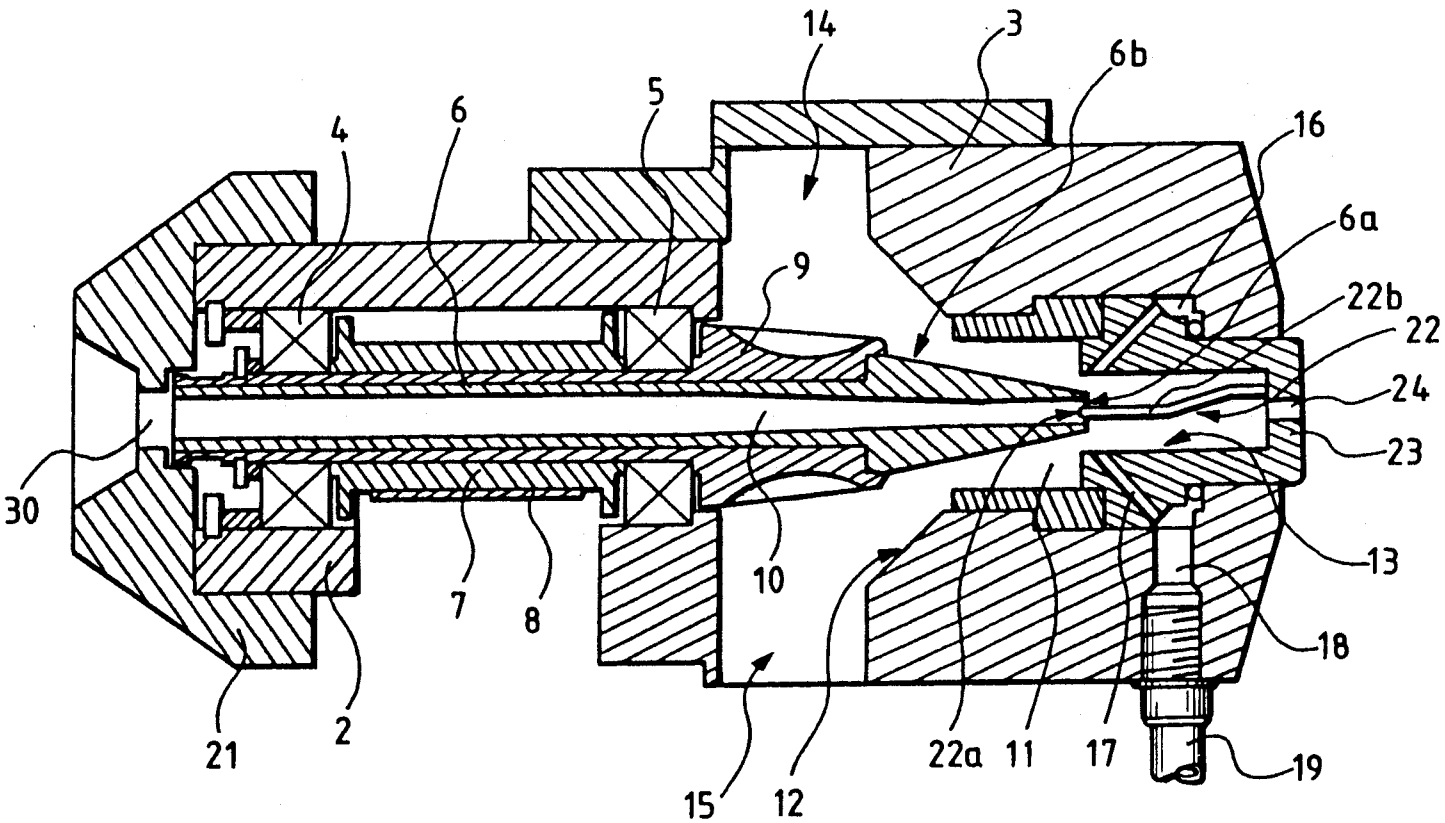
FIG. 3 is an enlarged detailed view of a spinning portion of the apparatus.

The casing 3 is interiorly formed with a hollow air chamber 16. There are formed four air jet nozzles 17 which are directed from the air chamber 16 to the spindle inlet 6*a* and directed in a tangential direction with respect to the hollow chamber 11 (FIGS. 1 and 3). An air hose 19 is connected to the air chamber 16 through a hole 18. The direction of the nozzle 17 is set to be the same as the rotational direction of the spindle 6.

Compression air supplied from the hose 19 flows into the air chamber 16, and thereafter moves into the hollow chamber 11 from the nozzle 17 to generate a high-speed turning air flow in the vicinity of the spindle inlet 6*a*.

The air flow turns within the hollow chamber 11 and thereafter scatters outwardly while slowly turning within the conical hollow chamber 12 and then guided toward and discharged out of the escape hole 15. At the same time, the air flow causes generation of a suction air flow which flows into the hollow portion of the casing 3 from the nip point N of a front roller 20.

Reference numeral 21 designates a cap mounted on the rear end of the bearing 2.

Further, in FIGS. 1 and 3, a guide member 22 is installed at the center portion of the passage 13, namely, in a direction along the flow of the fiber bundle S with one end secured to an inlet wall 23 and the other end set in a free state. In other words, the guide member 22 is provided between the drafting part D and the twisting portion (spindle 6 in this embodiment) in FIG. 1.

The guide member 22 is in the form of a needle in the embodiments shown in FIGS. 1 and 3. That is, the needle 22 is in the form of a pin smaller in diameter than a diameter of a passage of the inlet 6*a* of the spindle 6 and has an extreme end 22*a* formed by a smooth curve. At least in the vicinity of the inlet of the spindle, the center line of the needle has a portion 22*b* substantially parallel with the running direction of the fiber bundle.

While the extreme end 22*a* of the needle 22 shown is positioned to be somewhat entered into the passage 10 from the inlet of the spindle 6, it is to be noted that the extreme end 22*a* may assume the same position as that of the inlet end 6*a* or a position away from the inlet end 6*a*. It may be set to an adequate position in accordance with various conditions.

In FIG. 3, since an inlet 24 of the fiber bundle and the passage 10 of the spindle 6 are on the same straight line, the needle 22 is bended halfway for the purpose of mounting. However, in the case where the inlet 24 is formed to be one-sided upward and downward with respect to the passage 10, the needle 22 in the form of a straight line can be secured to the wall surface 23.

In addition, the shape of the guide member 22 is not limited to a needle but a rocket shape in which an extreme end of a conical and columnar body is narrowed, and other shapes can be employed.

The function of the guide member 22 is mainly to impede a propagation of twist during a yarn forming process described later, or temporarily play a role of the center core fiber so as to impede a formation of an untwisted core fiber bundle appearing in the conventional pneumatic type bundled spun yarns whereby in fact, yarns are formed by only the wound fibers.

In FIG. 1, reference numeral 25 designates a sliver charging guide, 26 paired back rollers, 27 a sliver-width defining guide, 28 paired middle rollers, and 29 an apron to form the drafting part D.

Next, the producing process of yarns by the fiber machine as described above will be explained.

The fiber bundle S drafted by the drafting device D and delivered from the front rollers 20 is drawn into the guide passage 13 by the suction air flow moving into the passage forwardly of the cylindrical portion (guide passage) 13. Since the tip of the suction pipe not shown comes into contact with the outlet 30 of the cap 21 prior to the delivery of the fiber bundle S from the front rollers 20, an air flow sucked into the spindle 6 is generated also in the vicinity of the inlet of the spindle 6, and the fiber bundle S moved deeper into the guide passage 13 is smoothly sucked into the spindle 6 by the suction air flow of the inlet of the spindle 6.

An upper yarn (which has passed through the spindle and therefore is already in the form of a yarn) having passed through the spindle 6 and sucked into the suction pipe is introduced into a yarn joining device by turning of the suction pipe and joined with a lower yarn on the package side likewise introduced by the suction mouth.

A peripheral speed of a delivery roller at downstream of the outlet 30 is set to be slightly higher than that of the front roller 20 so that tension is always applied to the fiber bundle S passing through the spinning apparatus A, in which state spinning step is carried out.

Next, the spinning process within the spinning apparatus A will be explained.

Figure 2:
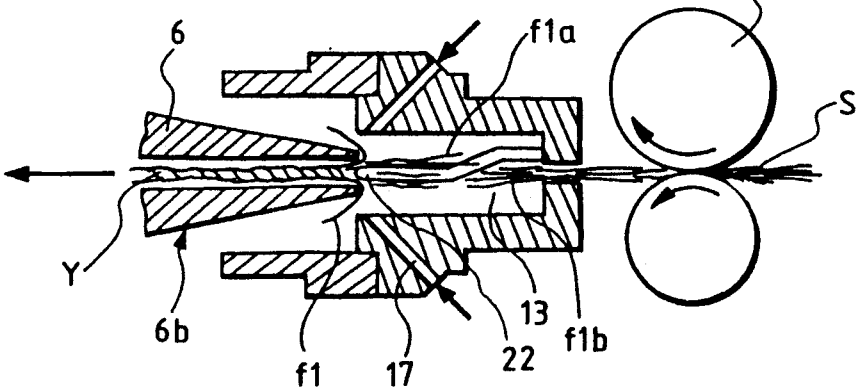
FIG. 2 is a schematic view showing the spinning state by the apparatus shown in FIG. 1.

That is, as shown in FIG. 2, the fiber bundle S receives the action of a flow of compression air jetted out of the air jet nozzle 17 in the vicinity of the inlet of the spindle and turned in the outer periphery of the spindle 6 so that the fiber bundle S is slightly twisted in the same direction. At this time, the fiber bundle is impossible to be positioned in a space occupied by the guide member due to the presence of the guide member 22. Accordingly, all the fibers are to assume a position around the guide member 22 and directly exposed to the air flow to receive a force so as to be separated from the fiber bundle S. However, when the extreme end of the fiber S is at the position of the spindle inlet 6, said extreme end is not easily separated since the extreme end is subjected to the twisting. The rear end of the fibers is not yet separated since it is nipped by the front rollers 20 as shown in FIG. 2 or it is at a position away from the nozzle 17 so that the action of the air flow may not be sufficiently received.

Subsequently, when a rear end fla of the fiber fl is disengaged from the front roller 20 and comes close to the air jet nozzle 17, it intensively receives the force of the air flow from the nozzle 17 and is separated from the fiber bundle S. The extreme end of the fiber fl is not separated since it is subjected partial twisting and inserted into the spindle which is less affected by the action of the air flow, and only the rear end fla of the fiber hardly subjected to twisting is separated from the fiber bundle S. The rear end of the fiber thus separated is wound once or plural times on the inlet of the spindle 6 by the action of the air flow and subsequently somewhat wound on the conical portion 6*b*, after which it is guided by the rotary body 9 and extended outwardly.

Then, the fiber bundle S keeps running leftward and the spindle 6 rotates. Therefore, the rear end fla of the fiber fl is gradually drawn while turning about the fiber bundle S.

As the result, the fiber fl is spirally wound about the fiber bundle S, and the fiber bundle S is formed into a bundled spun yarn Y which passes through the fiber bundle passage 10.

The fiber fl is separated from the whole outer periphery of the fiber bundle S during the producing process of the yarn Y and the fiber fl is separated whereby the fiber internally positioned is exposed to the air flow and further separated. Therefore, a number of fibers are continuously separated due to the presence of the fibers in the outer periphery of the guide member 20. The separated fibers are evenly distributed to the outer periphery of the spindle 6 and the conical portion 6*b*, and most of the fibers are twisted and wound with few fibers acting as a a core to form a real twisted yarn. The winding direction of the wound fibers fl is determined according to the direction of the air get nozzle and the rotational direction of the spindle 6 so that when the spindle 6 if rotated in a certain direction, the fibers are wound in a Z-twisting direction whereas when the spindle 6 is rotated in the opposite direction, the fibers are wound in a Z-twisting direction. The turning direction of the air flow by the air flow by the air jet nozzle 17 is preferably set in the same direction as the rotational direction of the spindle 6 so that the winding direction of the wound fiber fl is not disturbed and that the extreme end of the fiber is not separated due to the turning of the extreme end of the fiber.

As described above, according to the apparatus of the present embodiment, the twisting to be propagated from the twisting portion (spindle 6) toward the front roller 20 is impeded in its propagation by the guide member 22 so that the fiber bundle moved out of the front roller 20 is not twisted by twisting but most of fibers are formed into wound fibers.

This can be assured that the fibers are twisted by twisting propagated, in the vicinity of the central portion width of the roller of the flat fiber bundle moved out of the front roller 20, and stripe-like portions are produced in the running direction of the fiber bundle.

Figure 4:
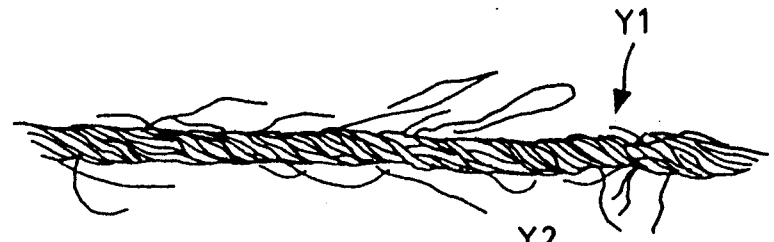
FIGS. 4 to 9 are views showing the external appearance of the spun yarns obtained by the apparatus and the positional relationship between a guide member and a spindle.
Figure 6:
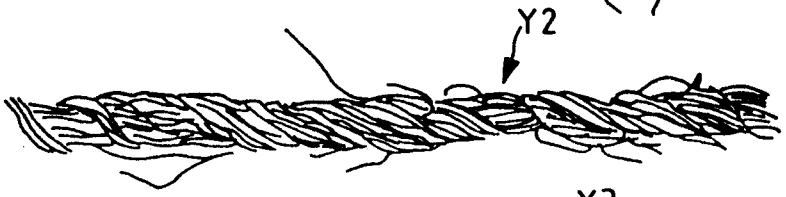
Figure 7:
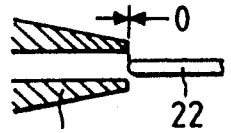
Figure 8:
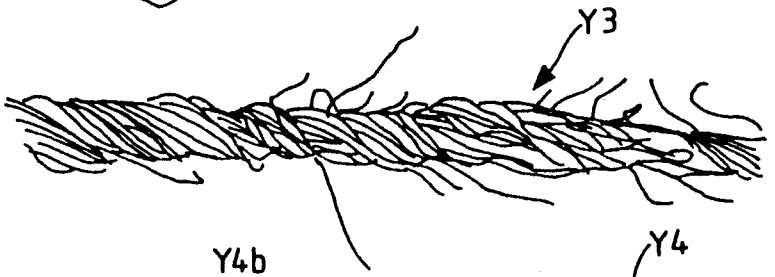

FIGS. 4, 6 and 8 show the external appearances of spun yarns produced by the apparatus according to the present embodiment.

The spinning conditions are as follows. Fibers used are cotton, 26 geren; total draft of a drafting part is 82; rpm of the spindle 6 is 60800 rpm; jet air pressure from the nozzle 17 is 1 kg/cm$^2$ to 6 kg/cm$^2$; spun yarn is Ne24; and yarn velocity is 106.5 m/min.

The spun yarn Y1 shown in FIG. 4 is obtained by moving the needle 22 in slight distance (a) into the passage 10 of the spindle 6 and has its external appearance of a ring-like spun yarn in which real twist of wound fibers is provided over the whole area of the yarn and internal untwisted core fiber is rarely present. That is, the wound fibers are almost continuously present over the lengthwise of the yarn, the winding angle is uniform and less irregularity of coarseness occurs.

The spun yarn Y2 shown in FIG. 6 is obtained by coinciding the extreme end of the needle 22 with the inlet end of the spindle 6, in which case also, a real twist yarn was obtained in which wound fibers having a uniform angle over the substantially whole area are present.

Figure 9:
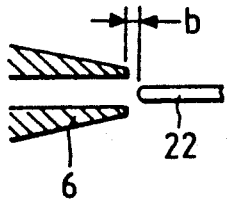

The spun yarn Y3 shown in FIG. 8 is obtained by moving the extreme end of the needle 22 away in slight distance (b) from the inlet end of the spindle 6 as shown in FIG. 9. A real twist yarn was obtained in which wound fibers are present over the substantially whole area of the yarn similarly to FIGS. 4 and 6.

Figure 5:
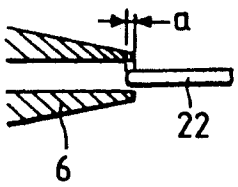

Among the aforementioned three examples, the spun yarn Y1 shown in FIG. 4 has an external appearance closest to the ring yarn. It is preferred that the needle 22 is in a position of FIG. 5, that is, the needle 22 is slightly moved into the passage of the spindle 6. While in the embodiment, the position in a direction perpendicular to the running direction of the fibers of the needle 22 is on the center line of the pipe-like passage 10, it is to be noted that a slight radial deviation indicates an allowable range. However, it is desired that the needle 22 be on the center line of the passage 10 in order that the fibers around the needle flows into the spindle at uniform fiber density from the whole periphery.

Figure 10:
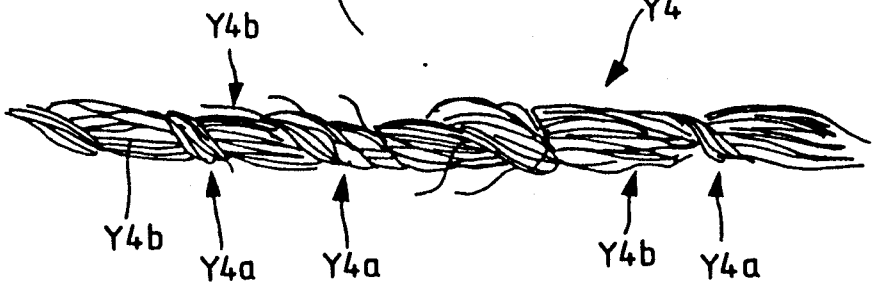
FIGS. 10 and 11 are views showing the external appearance of the spun yarns with the guide member deleted and the spindle with the guide member deleted.
Figure 11:
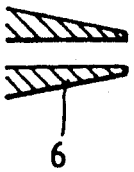

On the other hand, FIG. 10 markedly show the characteristics of the spun yarns shown in FIGS. 4, 6 and 8, showing the spun yarn Y4 obtained in the case where only the needle 20 is deleted and other conditions are similar to that of the aforesaid yarns. Apparently, in this case, the wound yarns Y4*a* are not present over the whole area of the yarn but merely partly present, and many untwisted or soft twisted core fibers Y4*b* are present. That is, this is the construction in which the wound fibers Y4*a* are spirally wound about the core fiber Y4*b* and is characterized in that the arrangement of the wound fibers is present with substantially equal pitch over the length of the yarns.

Figure 12:
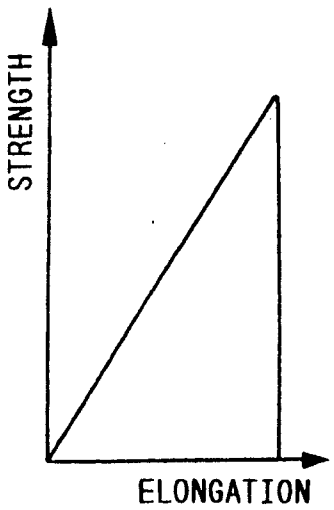
FIGS. 12 to 15 are S—S diagrams showing the relationship between the elongation and strength of various spun yarns.
Figure 13:
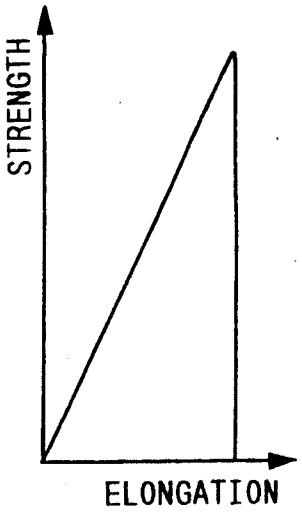

Next, experimental results of strength characteristics of spun yarn obtained by the apparatus of the present embodiment are shown. FIGS. 12 to 15 are S—S diagrams in which the axis of abscissa indicate the elongation and the axis of ordinate indicates the strength. FIG. 12 is an S—S diagram of the spun yarn (yarn Y1 of FIG. 4) obtained by the present invention, showing the characteristics extremely similar to the S—S diagram of the ring yarn obtained by the ring spinning machine shown in FIG. 13. The value of strength shown is 11.3 g/TEX, close to 90%, while that of the ring yarn is 13 g/TEX.

Figure 14:
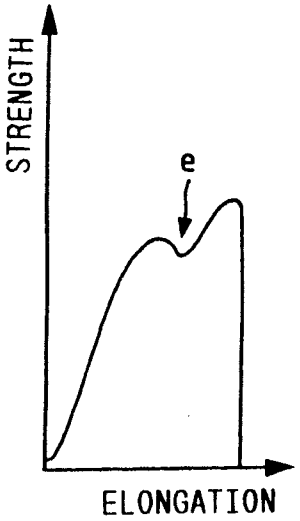

FIG. 14 is an S—S diagram of the spun yarn Y4 shown in FIG. 10, which shows a part (e) at which strength is temporarily down halfway of tension. It is presumed that this results from a deviation of fibers at a part at which the winding strength is partly weak.

Figure 15:
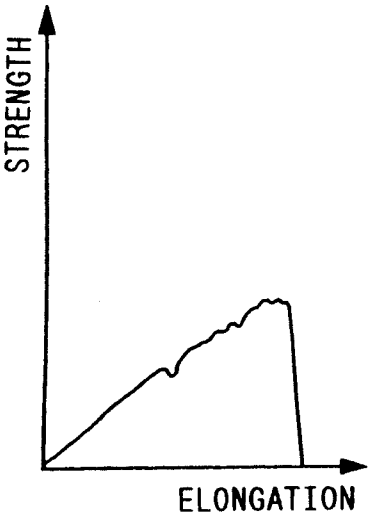

FIG. 15 is an S—S diagram of the spun yarn obtained by two nozzle devices shown in the aforementioned Patent Publication No. 53(1978)-45422, in which there is also a part at which strength is partly down. It is presumed that a deviation and slip occurs in a part of the fibers.

As described above, in the apparatus according to the present embodiment, the spun yarns show the characteristics of the ring-like yarn in external appearance and strength characteristics, and a real twist yarn is obtained in which the wound fibers are continuously present over the full length of the yarn.

While in the above-described embodiment, the case has been described in which the twisting portion is applied to the spindle type spinning apparatus, it is to be noted that the former can be applied to other apparatuses for obtaining bundled spun yarns. For example, a needle-like guide member may be provided at a first nozzle inlet of a 2-nozzle type described in the aforesaid patent or that may be applied to a spinning apparatus comprising a nozzle and a nip type twister and a spinning apparatus of a one-nozzle type according to the conditions.

Another embodiment of the guide member 22 will be described hereinafter.

Figure 17B:
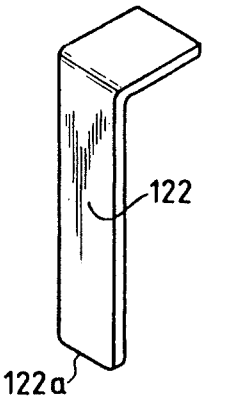
FIGS. 17*a* and 17*b* are views of guide members different in shape from each other.
Figure 17A:
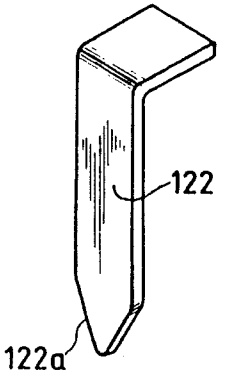

The guide member 122 is in the form of a flat plate as shown in FIGS. 17*a* and 17*b*, which has a width of 1.5 mm smaller than a diameter of 1.8 mm of the passage of the inlet 106*a* of the spindle 106 and a thickness of 0.5 mm. The extreme end of the guide member 122 may be sharpened as shown in FIG. 17*a* or may be as shown in FIG. 17*b*. In either case, yarns to be produced remain unchanged.

Figure 16:
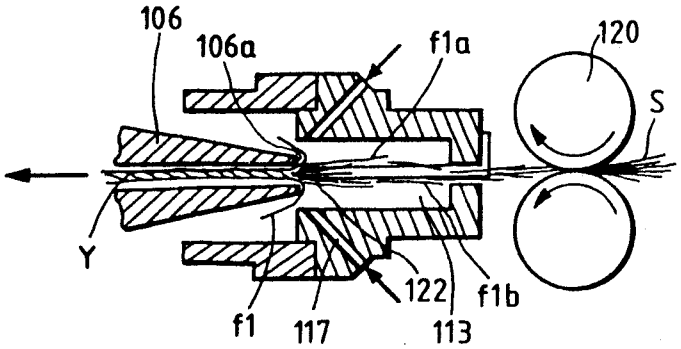
FIG. 16 is a schematic view showing a spinning state by a second embodiment.

While in FIG. 16, the extreme end 122*a* of the guide member 122 is at a position somewhat moved into the passage 110 from the inlet 106*a* of the spindle 106, it is to be noted that it may assume a position away from the end of the inlet 106*a*. Suitable positions can be set according to various conditions.

The guide member 122 has the function to impede a propagation of twist in the yarn forming process later described or temporarily play a role of the center fiber bundle, so-called false core, and impede formation of an untwisted core fiber bundle markedly appearing in conventional pneumatic type bundled spinning yarns whereby in fact, yarns are formed by only wound fibers.

Figure 19B:
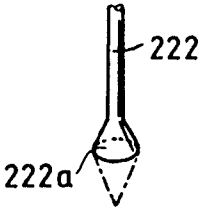
FIGS. 19*a* and 19*b* are views of guide members having tear drop and conical inflated portions, respectively.
Figure 19A:
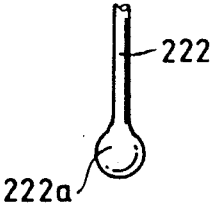
Figure 18:
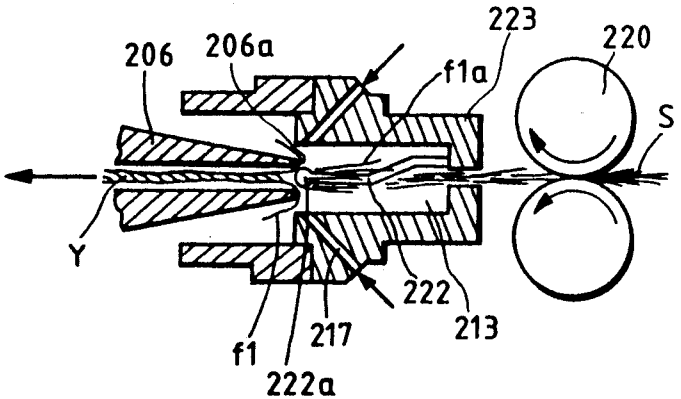
FIG. 18 is a schematic view showing a spinning state by a third embodiment.

The still another embodiment of the guide member 22 is illustrated in FIGS. 18 and 19. The guide member 222 is bended in its intermediate portion as shown and has one end secured to an inlet wall of a nozzle block 223. The other end of the guide member 222 faces to the inlet 206*a* of the spindle 206 in a free state. The guide member 222 is in the form of a pin having a diameter of 0.3 to 1.0 mm smaller than that of the passage of the inlet 206*a* of the spindle 206 and has its extreme end provided with a spherical or a tear drop as shown in FIG. 19*a* or a conical inflated portion 222*a* as shown in FIG. 19*b*. In either case, a moving portion from the pin-like portion to the inflated portion 222*a* need be smooth. For example, if the moving portion in which the spherical inflated portion 222*a* is provided on the pin-like portion is not smooth, fibers tend to be caught by the inflated portion 222*a* to stay therein, which is not preferable. By forming the inflated portion 222*a* which smoothly moves along the pin-like portion as described above, the fibers are spread as they pass, and therefore, the separation effect of the rear end of the fiber later described can be increased. Even if a reverse conical portion shown at the phantom line is provided as shown in FIG. 19, yarns produced remain unchanged.

Figure 20:
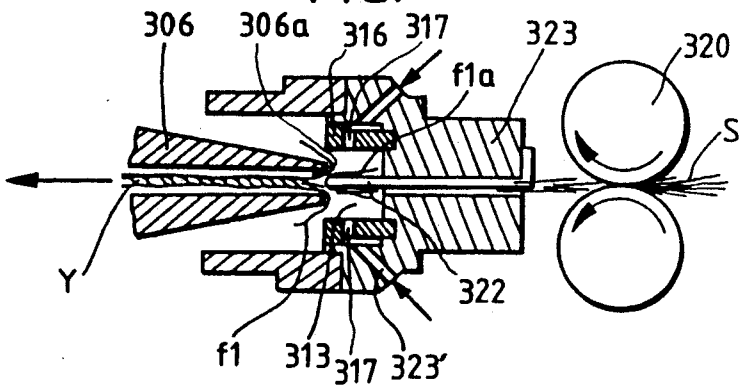
FIG. 20 is a schematic view showing a spinning state by a fourth embodiment.

Next, another embodiment of the nozzle 17 (shown in FIG. 3) is shown in FIG. 20.

The casing is interiorly formed with a hollow air reservoir adjacent to the nozzle block support body 323. The nozzle block support body 323 is formed with an air flow-passage 323' in communication with the air reservoir. The nozzle block support body 323 is internally provided with a nozzle block 316 through the air reservoir. At a position near the spindle inlet 306*a* of the nozzle block 316 are formed four air jet nozzles 317 which are communicated with the air reservoir, are perpendicular to the passage of the fiber bundle S, and are directed in a tangential direction with respect to the guide passage 313 in the form of a cylindrical portion. The nozzle 317 has a length 1.8 times of the diameter of the nozzle. An air hose 319 is connected through a hole 318 formed in the casing 3 in order to supply compression air to the air jet nozzles 319. The direction of the nozzle 317 is set to the same as the rotational direction of the spindle 306. It may be contemplated that the nozzles 317 are inclined in a moving direction of the fiber bundle S instead of perpendicularity with respect to the passage of the fiber bundle S. However, if this is employed, the nozzle length becomes 307 to 308 times of the nozzle diameter, resulting in a pipe loss of compression air due to the friction, that is, increasing a pressure loss, which is not preferable. Accordingly, when the nozzles 317 are formed perpendicular to the passage of the fiber bundle S, the pressure loss of the compression air becomes small and the turning force of the jet air increases, thus reducing the quantity of jet air.

Figure 22:
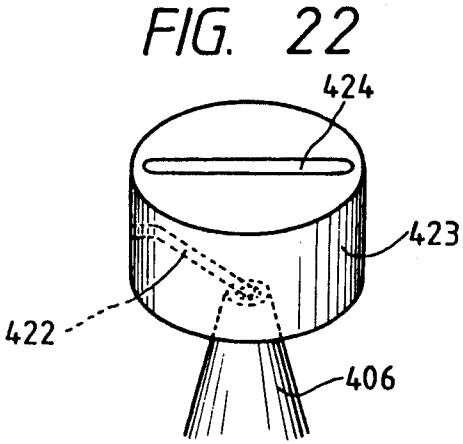
FIG. 22 is a view showing a state where a guide member is fixedly mounted on the inner wall of a nozzle block.
Figure 23:
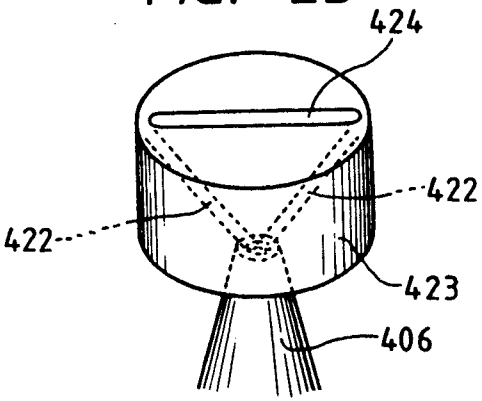
FIG. 23 is a view showing a state where a plurality of guide members are installed.
Figure 21:
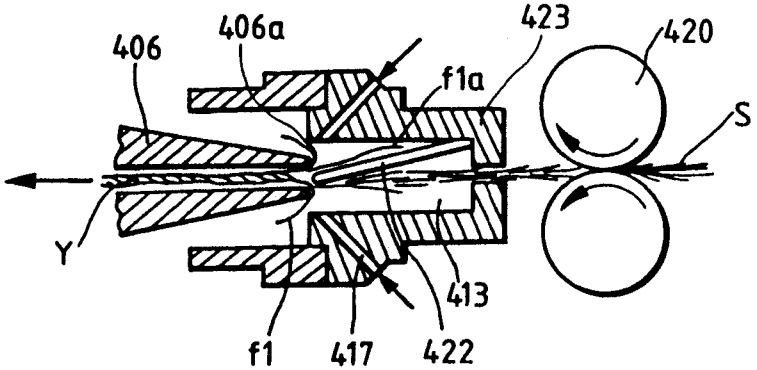
FIG. 21 is a schematic view showing a spinning state by a fifth embodiment.

Further embodiment of the guide member 22 (shown in FIG. 3) is shown in FIGS. 21 to 23.

One end of the guide member 422 is secured to the inner wall of the nozzle block 423 so as to be inclined with respect to the flow of the fiber bundle S. The other end of the guide member 422 faces to the inlet 406*a* of the spindle 406 in a free state. It is contemplated that the guide member 422 may be installed along the flow of the fiber bundle S. To this end, it is necessary to bend the guide member 422 in its middle portion so as to deviate the fixed end from the fiber bundle inlet 424 of the nozzle block 423. However, if the guide member is installed obliquely, such a device as described need not be made and the inlet 424 side of the nozzle block 423 is blocked by the guide member, not obstructing an entry of the fiber bundle S.

The position of fixing the guide member 422 to the inner wall of the nozzle block 423 may not only be the neighbourhood of the inlet 424 of the nozzle block as shown in FIG. 21 but also be the side wall of the nozzle block 423 as shown in FIG. 22. Further, similar yarns can be produced even if two or more guide members 422 are provided as shown in FIG. 23.

As shown in FIGS. 22 and 23, a slit 424 for introducing the fiber bundle S into the guide passage 413 is provided on the nozzle block 423. The slit 424 extends along the nip-line direction of the front rollers 420 and the fiber bundle S which is made to be flattened by the front roller 420 is introduced in the slit 424 in the flattened state. In the nozzle block 423, the guide member 422 is mounted within the center portion of the guide passage 413, that is, along the advancing direction of the fiber bundle S. The extreme end of the guide member 422 faces to the inlet 406*a* of the spindle 406 in a free state. The guide member 422 may be secured to the nozzle block 423 by bending one end of the guide member 422 and fixing the bended portion on the outside of the nozzle block 423 through the inlet 424.

In this embodiment, the sliver drawn out from the nip roller 420 being flattened thereby is fed in the flattened state to the inlet 424 which is formed in the same plane as that of the nip line. So, the sliver do not receive undesirable force for deviating the sliver to upward or downward and fluctuation of the tension of the sliver is not caused.

As described above, according to the present invention, a fiber bundle guide member is provided inside or outside of a flow of a fiber bundle between front rollers of a drafting part and a twisting portion. Therefore, it is possible to produce real twist yarns having a large quantity of wound fibers.

What is claimed is:

1. An apparatus for producing yarn comprising:

drafting means for drafting a fiber bundle, the fiber bundle defining an inner portion, twisting means for twisting the drafted fiber bundle to produce a yarn, and guide means for guiding the fiber bundle, the guide means having a portion thereof disposed within the inner portion of the fiber bundle being supplied from the drafting means to the twisting means.

2. An apparatus as claimed in claim 1, wherein the twisting means includes a casing having a nozzle block for exerting a turning stream on the fiber bundle, and a spindle having one end located within the casing, the spindle having a passage therethrough, wherein the guide means is disposed within the nozzle block.

3. An apparatus as claimed in claim 2, wherein the spindle is a rotary spindle.

4. An apparatus as claimed in claim 2, wherein the spindle is a stationary spindle.

5. An apparatus as claimed in claim 2, wherein the guide means comprises a guide member having a needle-shaped portion, the needle-shaped portion including an end formed with a smooth curve, wherein a center line portion of the needle-shaped portion is substantially parallel with a running direction of the fiber bundle at least in the vicinity of an inlet of the spindle.

6. An apparatus as claimed in claim 5, wherein the needle-shaped portion is smaller in diameter than a diameter of the inlet of the spindle.

7. An apparatus as claimed in claim 6, wherein a portion of the guide member is disposed within the passage through the spindle.

8. An apparatus as claimed in claim 6, wherein the end of the needle-shaped portion is arranged along a running path of the fiber bundle and substantially adjacent to the inlet of the spindle.

9. An apparatus as claimed in claim 6, wherein the end of the needle-shaped portion is arranged substantially adjacent to the inlet of the spindle.

10. An apparatus as claimed in claim 2, wherein the guide means comprises a flat plate-shaped guide member having one end secured to the nozzle block and another end directed at an inlet of the spindle.

11. An apparatus as claimed in claim 2, wherein the guide means comprises a rod-shaped member having an end directed at an inlet of the spindle.

12. An apparatus according to claim 11, wherein the guide means includes a spherically-shaped portion disposed at the end of the rod-shaped member.

13. An apparatus according to claim 12, wherein a diameter of the spherically-shaped portion is at least equal to a diameter of the rod-shaped member.

14. An apparatus according to claim 11, wherein the guide means includes a conically-shaped portion disposed at the end of the rod-shaped member.

15. An apparatus according to claim 14, wherein a diameter of the conically-shaped portion is at least equal to a diameter of the rod-shaped member.

16. An apparatus as claimed in claim 2, wherein the guide means comprises a needle-shaped guide member disposed obliquely with respect to a moving direction of the fiber bundle, wherein an end of the needle-shaped guide member is directed at an inlet of the spindle.

17. An apparatus as claimed in claim 2, wherein the nozzle block includes a slit for allowing the fiber bundle to pass therethrough, and wherein the guide means comprises a guide member having one end secured to the nozzle block and another end directed at an inlet of the spindle.

18. An apparatus as claimed in claim 2, wherein the nozzle block includes a plurality of air jet nozzles which are directed at an inlet of the spindle in a tangential direction with respect to a passage of the fiber bundle.

19. An apparatus as claimed in claim 2, wherein the nozzle block includes a plurality of air jet nozzles for generating a turning stream of air perpendicular to a passage of the fiber bundle.

20. An apparatus as claimed in claim 1, wherein the guide means forms a temporary core for the yarn such that a plurality of fibers wind about the guide means during production of the yarn, the guide means impeding formation of a yarn having an untwisted core fiber bundle.

21. An apparatus as claimed in claim 1, wherein the guide means is disposed so as to impede the propagation of twists from the twisting means toward the drafting means during production of the yarn.

22. A method for producing yarn comprising the steps of:

drafting a fiber bundle in a drafting device, the fiber bundle comprising an inner portion, introducing the drafted fiber bundle into a twisting device, providing a fiber guide having a portion thereof disposed within the inner portion of the fiber bundle, and guiding the drafted fiber bundle with the fiber guide, wherein the guide member impedes twists in the fiber bundle from propagating from the twisting device toward the drafting device.

* * * * *